US006708639B2

(12) United States Patent
Cottrell et al.

(10) Patent No.: US 6,708,639 B2
(45) Date of Patent: Mar. 23, 2004

(54) SINGLE POINT MOORING WITH SUSPENSION TURRET

(75) Inventors: Roy H. Cottrell, Cypress, TX (US); L. Terry Boatman, Houston, TX (US)

(73) Assignee: FMC Technologies, Inc., Chicago, IL (US)

( * ) Notice: Subject to any disclaimer, the term of this patent is extended or adjusted under 35 U.S.C. 154(b) by 0 days.

(21) Appl. No.: 10/368,883

(22) Filed: Feb. 19, 2003

(65) Prior Publication Data

US 2003/0154899 A1 Aug. 21, 2003

Related U.S. Application Data

(60) Provisional application No. 60/357,761, filed on Feb. 19, 2002.

(51) Int. Cl.[7] ..... B63B 21/00
(52) U.S. Cl. ..... 114/230.12; 441/4
(58) Field of Search ..... 114/230.12, 230.13; 441/3–5

(56) References Cited

U.S. PATENT DOCUMENTS

| | | | | |
|---|---|---|---|---|
| 3,191,201 A | * | 6/1965 | Richardson et al. | 441/3 |
| 5,052,322 A | | 10/1991 | Poldervaart et al. | 114/230 |
| 5,266,061 A | | 11/1993 | Poldervaart et al. | 441/5 |
| 5,584,607 A | | 12/1996 | De Baan | 405/224 |
| 5,782,197 A | | 7/1998 | Pollack | 114/230 |
| 5,860,382 A | | 1/1999 | Hobdy | 114/230 |
| 5,893,784 A | | 4/1999 | Boatman | 441/3 |
| 5,913,279 A | | 6/1999 | Braud et al. | 114/230.12 |
| 5,957,076 A | | 9/1999 | Pollack et al. | 114/230.12 |
| 6,126,501 A | | 10/2000 | Hooper et al. | |
| 6,269,762 B1 | | 8/2001 | Commandeur | |
| 6,305,560 B1 | | 10/2001 | Meyer | |

FOREIGN PATENT DOCUMENTS

| | | |
|---|---|---|
| EP | 0668210 A1 | 8/1994 |
| EP | 0815002 B1 | 1/1998 |
| GB | 1014879 | 12/1965 |
| GB | 2297530 A | 8/1996 |
| WO | WO 98/31585 | 7/1998 |

* cited by examiner

*Primary Examiner*—Jesus D. Sotelo
(74) *Attorney, Agent, or Firm*—Gary L. Bush; Andrews Kurth LLP

(57) ABSTRACT

An arrangement for suspending a Single Point Mooring Turret from its corresponding vessel, by transmitting a circumferentially uniform axial vertical load without moment through the interface of motion between the vessel and turret, by decoupling mooring system loads, inertial loads and hull deflection induced loads, from transmission across that interface. The arrangement supports the turret through a pendular suspension system which includes bogies, having one or more wheels or rollers per bogie, which roll around the circumference of the moonpool on a rail to allow the bogies to rotate in a horizontal plane which is perpendicular to the center line of the moonpool, and to decouple the bearing loads from radial hull deflection due to ovaling caused by rough seas. Radial flexure is achieved by suspending the turret from the bogie through rocker arms and chains, cables, rods or columns between the bogies and a riser support structure of the turret.

22 Claims, 9 Drawing Sheets

FIG. 15
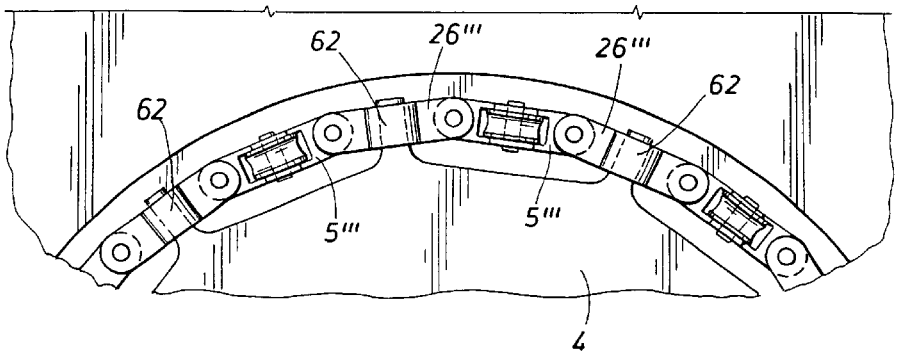
FIG. 16
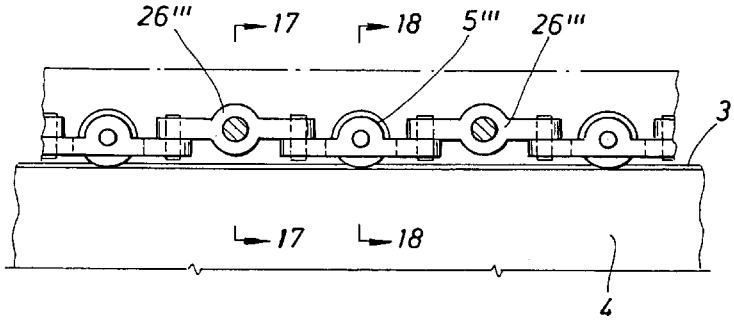
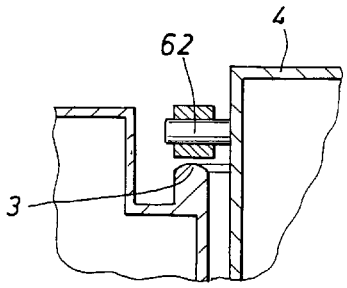
FIG. 17
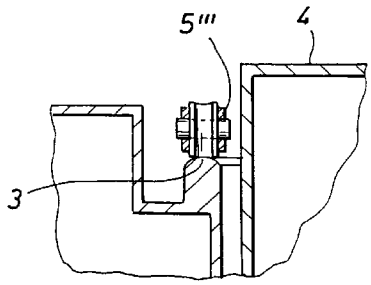
FIG. 18

SINGLE POINT MOORING WITH SUSPENSION TURRET

RELATED APPLICATION

This application is based on Provisional Application 60/357,761 filed on Feb. 19, 2002, the priority of which is claimed.

BACKGROUND OF THE INVENTION

1. Field of the Invention

This invention relates generally to mooring systems for offshore vessels and Floating Production Units ("FPUs") such as Floating Storage and Offloading vessels ("FSOs"), Floating Production Storage and Offloading vessels ("FPSOs"), Floating Storage Drilling Production and Drilling Units ("FPDSOs") and in particular to turret mooring arrangements or systems where a turret is rotatably supported on the vessel, and where the turret is fixed to the sea bed by anchor legs so that the vessel can weathervane about the turret.

2. Description of the Prior Art

Single point mooring systems using bearings, bogies, sliding elements and hydrostatic bearings at the interface of the motion between the geostationary turret and weathervaning hull are commonplace. Typically, the turret is a rigid tubular structure which transfers not only axial (vertical) loads from the mooring legs and risers, suspended therefrom, but also moments induced by mooring leg loads, hull deflections and any concentric radial misalignment between the lower sliding bearings at the vessel bottom and the motion interface at or near the deck. The moments and loads exerted on the bearings, bogies, or sliding element system reduce the efficiency of the interface and require additional cost to accommodate loads imparted by the interface itself which does not contribute directly to station keeping or riser support. These moments, deflection, and misalignment problems are common to single point mooring turrets of all sizes, which have a rigid turret connected to a deflecting hull, and depending on the method used for their remediation, they can result in a reduction in efficiency of the motion interface of as much as fifty percent. As the diameter of the turret increases, the material remaining in the hull outside the moon pool decreases, further exacerbating hull deflection problems at the hull-turret interface.

A second problem is the lack of machining capability in diameters large enough to accommodate a large size turret necessary for running as many risers as possible from the sea floor to a FPSO. Although the traditional limit has been around 50 risers per turret, recent interest puts the number as high as 40 to 120 risers per turret with the risers arranged in two concentric rows around the circumference of the turret. Given minimum distances required between risers for riser installation, the avoidance of clashing among them, and the provision for capability of their replacement during service, the diameter of the turret at the riser interface begins to exceed the limit of current roller bearing technology and therefore requires bogie wheels at the motion interface. If bogie wheels (or simply "bogies") are connected to the rigid structure, at both the hull and turret side of the interface, any vertical deformation of the interface results in some bogies carrying more loads than their neighbors do. For full efficiency, the two surfaces must be described by a locus of points circumferentially, which is part of two perfectly parallel planes. In practice for very large turrets, such parallel plane condition is impractical to achieve especially during operation at sea.

Several methods have been proposed for eliminating or accommodating the moments, deflections, and alignment problems associated with mounting a rigid turret within a flexing hull.

Diameter Reduction

U.S. Pat. No. 5,517,937 shows a turret of large diameter at the riser connection below, narrowing to a small diameter at the bearing location above, through terminating the upper ends of groups of riser guide tubes at different heights.

U.S. Pat. No. 5,584,607 and European Patent Application 0 668 210 A1 show a configuration for riser connection where the chain table is increased in diameter below the lowest bearing and at an elevation which is below the hull. Because the diameter of the circumferential rows of risers is outside the diameter of the turret shaft, special risers pull in and connection hardware is shown.

UK Patent Application GB 2 297 530 A shows a framework attached to the bottom of the turret structure which splays the risers outward in a radial direction to achieve the clearance necessary for installation, clash avoidance and replacement. In this way, the turret shaft and its associated bearings and machining can be minimized, while offering a path for many risers.

Isolation of Bearing from Hull Deflection

U.S. Pat. No. 5,052,322 shows a turret bearing mounted on a vertical extension of the cylindrical moon pool, which is connected rigidly at its base at a height below the main deck and thereby closer to the neutral axis of the ship's hull and at a distance away from that connection and through an independent rigid ring that isolates that bearing from its hogging and sagging deflection of the hull.

U.S. Pat. No. 5,266,061 inverts the concept shown in U.S. Pat. No. 5,052,322, by extending the moon pool downward and mounting the bearing below the waterline, to isolate the bearing from the deflections of the hull.

WO 98/31585 copies the cylindrical support and rigid upper ring concepts shown by U.S. Pat. No. 5,052,322; however, WO 98/31585 utilizes bogies in lieu of a roller bearing. It also allows the equalization of load among the bogies through mounting on elastic members capable of flexure in the vertical direction.

Moment Elimination

U.S. Pat. No. 5,782,197 eliminates the moment induced by misalignment between the lower and upper bearing through mounting the upper bearing on a rigid ring which is in turn mounted on elastic mounts which permit the turret to swing in a pendular fashion about a point which acts as the virtual center of the sphere described by the relative motion of the bearing about that point above its central axis. In this way the upper bearing avoids misalignment induced moments and is able to flex somewhat in response to mooring system induced moments.

Compliant Mounting Arrangements for Bearings

U.S. Pat. No. 5,860,382 shows a radial roller used to center the turret within the moon pool, accommodating the flexure of the hull and ovality of the turret through mounting that radial roller on a radially compliant spring.

U.S. Pat. No. 5,893,784 shows a bearing support structure compliantly mounted on a frame supported by springs in the vertical direction. These springs allow flexure of the hull while maintaining a fairly uniform circumferential loading around the bearing.

U.S. Pat. No. 5,957,076 shows hydrostatic bearings, which provide a uniform circumferential load between the hull moon pool and upper edge of the turret structure. They require precise machining, sealing and are still subject to deflection of the moon pool in the radial direction due to ovality.

Alternate Load Path

Both U.S. Pat. No. 5,913,279 and EP 0815 002 B1 show configurations which allow moments and deflections to be transferred into the upper bearing up to a point at which radial sliding bearings come into contact to limit further transmission of loads and moments.

Identification of Objects of the Invention

A primary object of the invention is to provide a turret support system which can accommodate a large number (such as from about 40 to 120) of risers.

Another object of the invention is to provide a turret support system which isolates the upper bearing from vertical hull deflections of hog and sag.

Another object of the invention is to provide a turret support system which isolates the upper bearing from radial hull deflections of the moon pool due to ovality.

Another object of the invention is to provide a turret support system which exerts vertical loads on the upper bearing without induced moments.

Another object of the invention is to provide a turret support system which increases tolerance to radial misalignment between the center of the lower bearing and upper bearing.

Another object of the invention is to provide a turret support system which increases tolerance to circumferential misalignment while maintaining a uniform sharing of load among all load-bearing elements.

SUMMARY OF THE INVENTION

The objects identified above along with other advantages and features are incorporated in a system which suspends a single point mooring turret from bogie wheels which are arranged to roll along a rail of the FPSO hull. The system utilizes a pendular suspension system including rocker beams carried by the bogies which help transfer a circumferentially uniform axial load without moment through the interface of motion between the vessel and turret, by decoupling system loads, inertial loads, and hull deflection induced loads across that interface. The bogies are seated on a rail which allows the bogies to roll about the circumference of the moon pool. Suspending the turret from the bogies decouples radial hull deflections due to ovality, because the rail is not connected rigidly to the turret in the radial direction. A set of bogie rocker beams is coupled to the bogies. The bogie rocker beams are coupled to a set of turret rocker beams which are coupled to the turret. In one embodiment the turret is suspended via chains, cables, rods, columns, or the like between the bogie rocker beams and the turret rocker beams. In another embodiment, the turret is directly connected to the turret rocker beams. The rocker beams have equal arm lengths, and thereby equally share the vertical load imparted to any one bogie, thus reducing any moment on the bogies. Moments induced by the mooring system or inertial moments are counteracted via radial rollers or sliding bearings at the deck edge and bottom edge of the turret/vessel interface. The radial rollers or sliding bearings also provide vertical stability and centering of the turret within the moon pool.

BRIEF DESCRIPTION OF THE DRAWINGS

FIGS. 15, 16, 17 and 18 show plan, radial and circumferential views of a turret suspension system without tension members with turret rocker beams resting directly on bogie housings formed with integral rocker beams.

DESCRIPTION OF THE INVENTION

Figure 1:
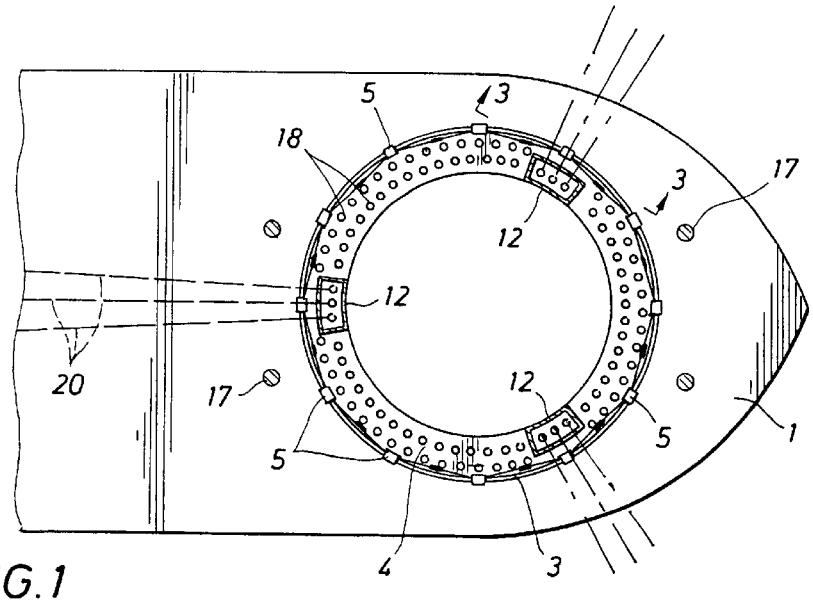
FIGS. 1 and 2 show plan and profile views of the structural and mechanical arrangement of the suspension turret according to the invention with the plan view of FIG. 1 taken along lines 1—1 of FIG. 2.
Figure 2:
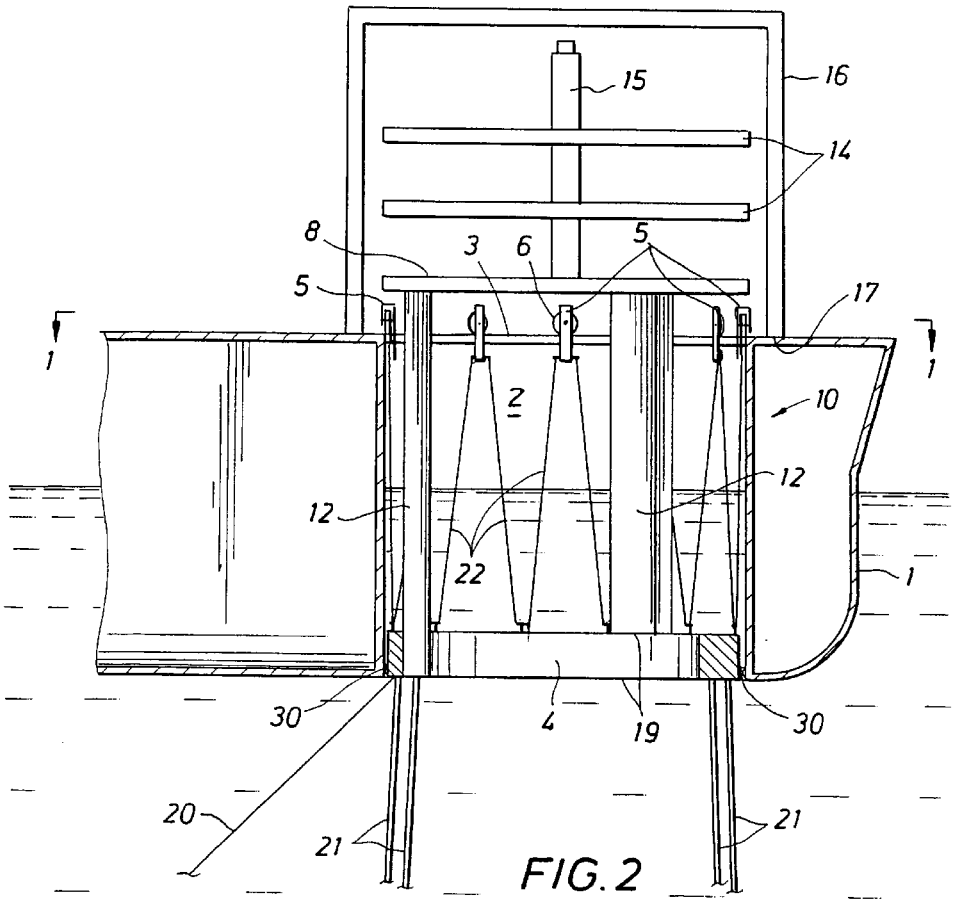

FIGS. 1 and 2 illustrate an embodiment of the invention in plan and profile views of the structural and mechanical arrangement of the suspension turret 10. The structural and mechanical arrangement supports a Single Point Mooring Turret 4 through a pendular suspension system consisting of bogie housings 5, or "bogies", having one or more wheels 6 per bogie 5, arranged to roll around the circumference of the moonpool on cambered or dished (not shown) rails 3. The rails 3 allow the bogies 5 to move in the radial direction while supporting their vertical loads, without substantially increasing radial loads thereby decoupling the bearing loads from radial hull deflections due to ovality. Radial flexure is achieved by hanging the turret 4 from the bogies 5 via suspension members 22 such as chains, cables, rods, columns, or the like, between the bogies 5 and riser support structure 19 of turret 4, such that the bogies 5 are not rigidly connected to the turret 4 in the radial direction.

Figure 5:
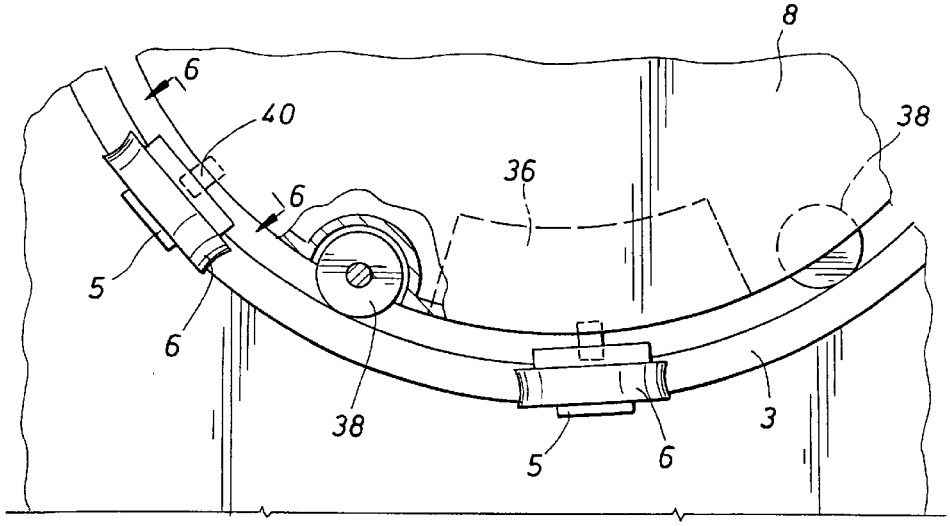
FIG. 5 is a plan view of the riser guide tube deck showing pins for radial connection thereof to bogies and showing upper radial bearings between a riser guide tube deck and the rail.
Figure 6:
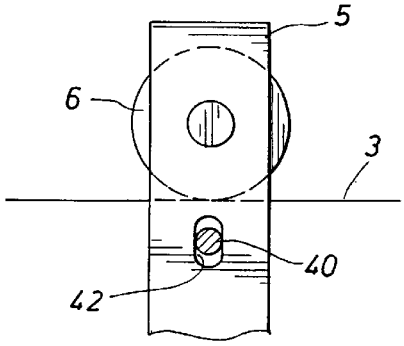
FIG. 6 is a view taken along lines 6—6 of FIG. 5 which shows a coupling between the pin and the bogie.

FIGS. 1 and 2 show that the vessel 1 has a moonpool 2 provided in a middle portion of the hull 1 and with anchor legs 20 providing anchoring of the turret 4 to the sea floor (not shown). The suspended turret 4 includes upwardly extending turret deck supports 12 to which riser guide tube deck 8 is supported as illustrated in FIG. 5. Upper radial rollers 38 or sliding bearings are provided between the riser guide tube deck 8 and the rail 3. Radial pins 40 are provided as shown in FIGS. 5 and 6 for coupling the turret riser guide tube deck 8 to bogie housings 5. FIG. 6 illustrates that pins 40 ride in an oval slot 42 to allow vertical displacement between guide tube deck 8 and rail 3 as the vessel weathervanes with respect to the turret, that is as the rail 3 rotates with respect to the geostationary riser guide tube deck 8.

Again referring specifically to FIGS. 1 and 2, the turret deck supports 12 (for example, three supports) extend upwardly beyond rider guide tube deck 8 for support of other decks 14 such as a pull-in/pig deck, a manifold deck and a piping and instrument deck. A swivel stack 15 is supported from such decks, and a swivel support structure 16 supported at positions 17 on the deck of hull 1 are provided. Riser guide tubes 18, e. g., from 40 to 120 in number, extend from riser support structures 19 of turret 4 to riser guide tube deck 8. Risers 21 are illustrated schematically as extending through riser guide tubes 18. A lower radial bearing 30 is provided at the lower end of the turret 4 between radially facing circumferential surfaces of the moonpool 2 and the turret 4.

The turret of FIGS. 1 and 2 is not buoyant, but a buoyant turret structure can be provided (not illustrated) such that the buoyancy provided assists in the reduction of the vertical loads on the bogies 5 and the rail 3. In such a configuration, vertical loads would be shared between the bogies 5 and the buoyant turret structure.

Figure 4:
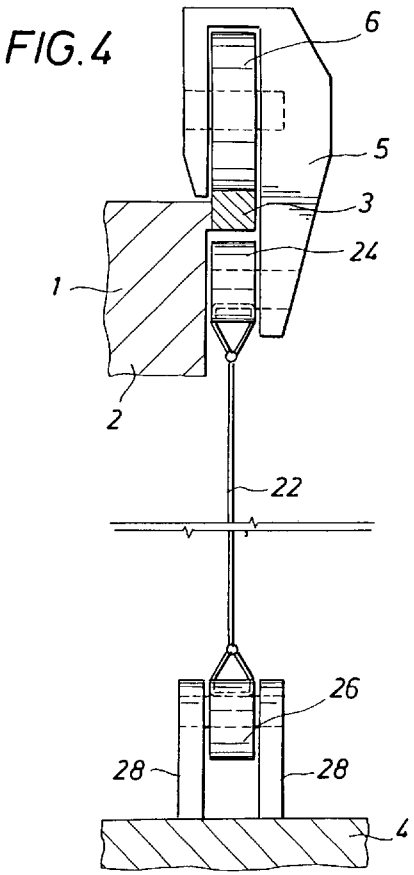
FIG. 4 is a view taken along lines 4—4 of FIG. 3 that presents a circumferential view of the suspension of the turret in a vessel moonpool from bogie wheels on a rail carried by the vessel.
Figure 3:
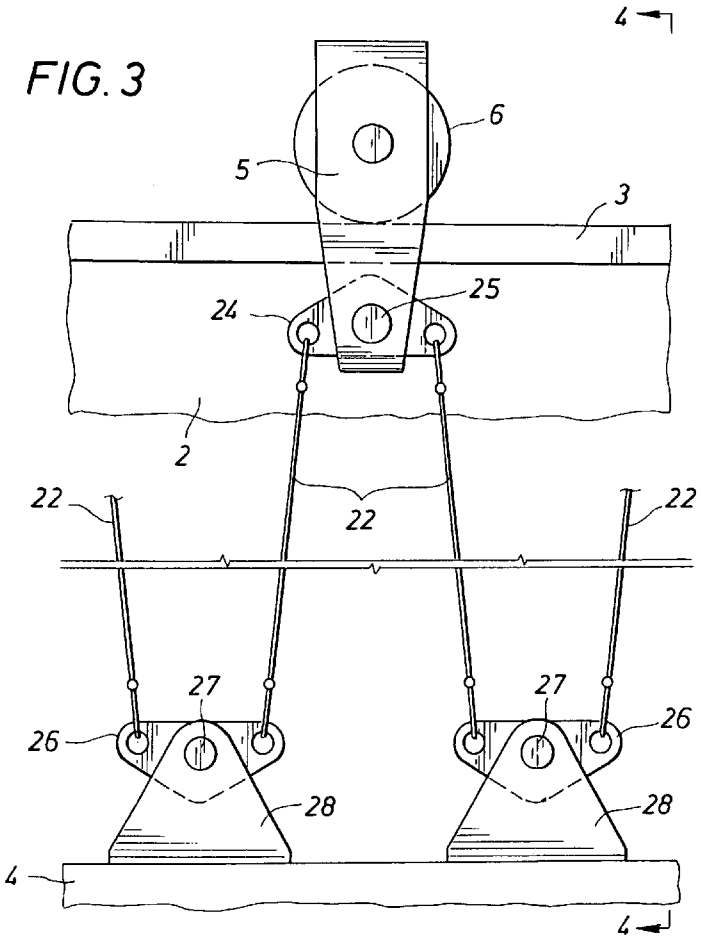
FIG. 3 is a radial view of the turret arrangement taken along lines 3—3 of FIG. 2 and shows suspension of turret rocker beams from bogie rocker beams.

FIG. 3 shows a radial view of the suspension system looking along view lines 3—3 of FIG. 1. The bogie wheels 6, carried by bogie 5 is supported on the upward facing surface of rail 3. FIG. 4 is a circumferential view taken along lines 4—4 of FIG. 3. The bogie rocker beams 24 are pivotably supported by pins 25. Support members 28 are mounted on a riser support structure of turret 4. Turret rocker beams 26 are pivotably supported by pins 27. Each bogie rocker beam 24 is connected to corresponding turret rocker beams 26 by means of suspension members 22 which can be tension members such as cables or chains or by compression members such as rods or pipes.

The suspension system rocker beams 24, 26 at both the bogie and the turret riser support structure shown in FIGS. 1–4 and in the alternative embodiment below have equal arm lengths and for that reason exert the same tension at each end, thereby sharing the tension equally around the entire circumference of the rail 3 with equal loads imparted to each bogie. This equality results in a circumferential distribution of vertical load which is constant and uniform around the circumference of the rail 3 regardless of small differences in the height of the rail around the circumference of the moon pool 2 and regardless of the extent of vessel 1 hog, sag, and ovality. Because the load is shared uniformly around the circumference of the vessel moon pool 2, regardless of initial accuracy or subsequent distortion, the surface of the rail can be pre-machined in segments and joined and shimmed aboard the ship to acceptable accuracy, without the need for in-situ machining. This facilitates the use of this configuration for all sizes of turrets, no matter how small or big in diameter.

Because the vertical component of the bogie load is uniform around the circumference of the motion interface, the load distribution by definition exerts no moment on the set of bogies 5. The suspension member 22 connection at the turret connection points at the rockers 26 at the bottom of each suspension member 22 is below the center of gravity of the turret 4. This arrangement allows that the vertical cylindrical wall structure, normally provided just inside the moon pool for turrets, can be eliminated, with a resultant saving of weight and cost. However, because the center of gravity is above the center of horizontal roll, the turret 4 is inherently unstable while suspended on rocker beams only. Moments induced by the mooring system or inertial moments due to vessel motions are counteracted with the arrangement shown in FIGS. 5 and 6 through the couple created between radial rollers 38 (or sliding bearings) at the deck edge 8 and the radial bearing 30 (FIG. 2) at the bottom edge. This couple creates the stability necessary to maintain the turret 4 centered and approximately coaxial with respect to the surrounding moon pool 2. The walls of the turret 4 can be extended upward toward the vessel deck and turret rocker beams installed just below the bogie rocker arms. In this way, a horizontal axis of rotation can be positioned above the center of gravity of the turret for inherent stability, albeit at the expense of additional structure.

The stability of the turret can also be improved by elongating the rocker beams 24, 26 vertically as shown.

Figure 3A:
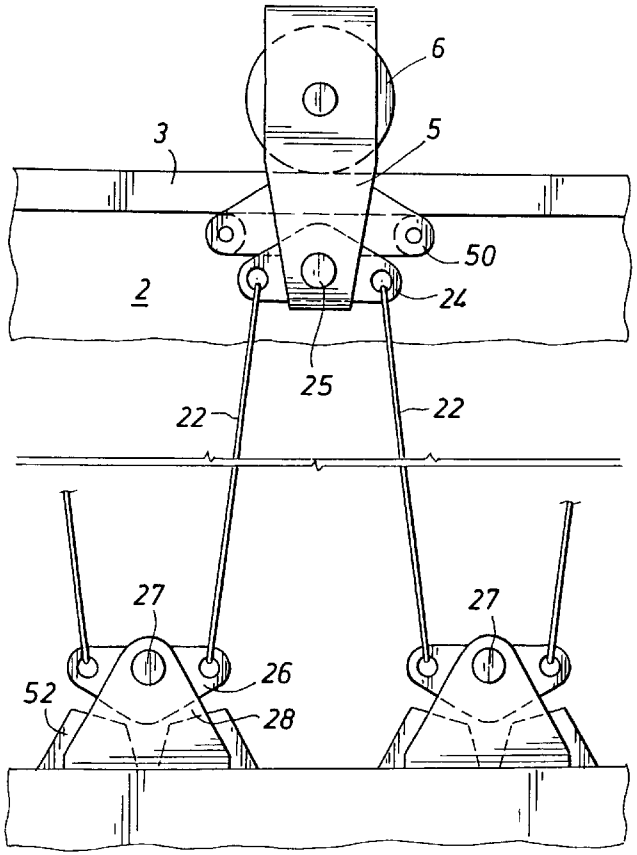
FIG. 3A is a view like that of FIG. 3 but shows anti-uplift wheels and an alternative rocker arm with a safety stop for tension member failure or replacement.

FIG. 3A illustrates an optional anti-uplift assembly with anti-uplift wheels 50 positioned between rail 3 and rocker beams 24. Such anti-uplift wheels 50 will be effective where suspension members 22 are compression members such as rods or pipes. Also shown in FIG. 3A is an optional safety stop 52 placed between a support member 28 which supports a rocker beam 26 if tension member 22 were to fail or required replacement.

FIGS. 1, 3, 3A, 4, 7A show radial and circumferential views of the bogies 5 and rocker beams 24 suspension system with the bogies 5 at the top. The rocker beams 24 can be made in an alternative tri-plate configuration which provides greater stiffness in moment about the horizontal axis of rotation. Such an arrangement assists the rocker beams 24 to remain near the center of their vertical stroke, to prevent all beams 24 from tilting in the same direction. In the event of a tension member 22 failure, rocker beam rotation stops 52 (See FIG. 3A) can be fitted, while the tension member 22 is replaced. The remaining legs accommodate the load sharing in the same way with one leg missing. Alternatively, the tension members 22 can be dual parallel path members for redundancy (not shown).

Figure 7A:
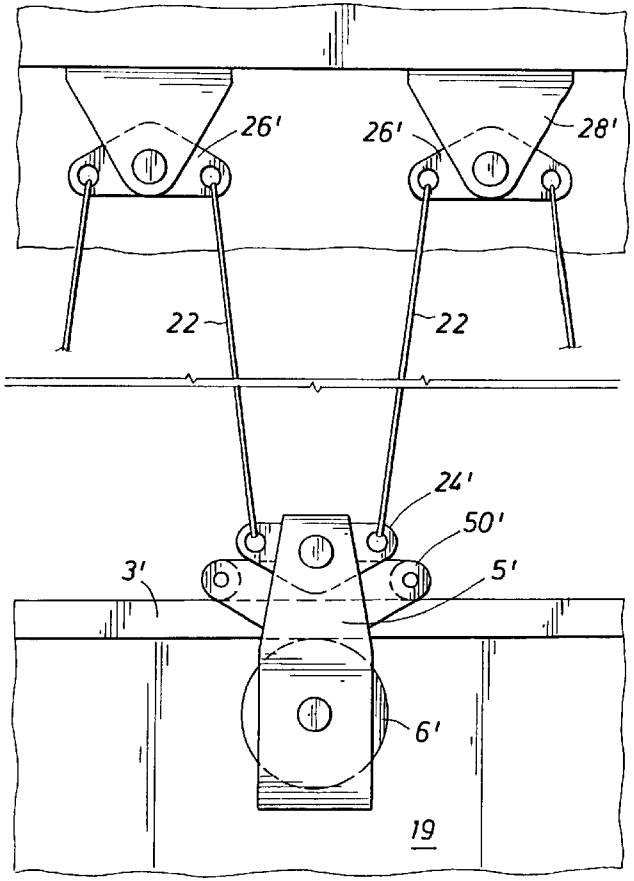
FIG. 7A is a view like that of FIG. 7 but shows anti-uplift wheels mounted between the rail and the bogie housing rocker arm.
Figure 8:
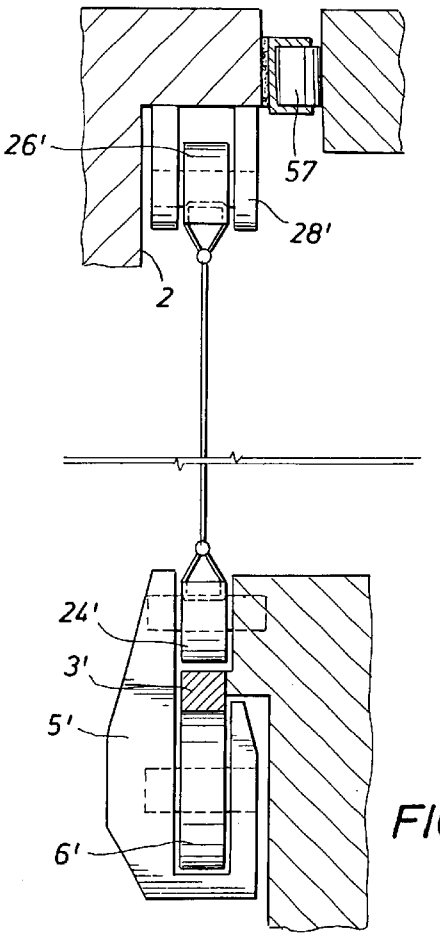
FIG. 8 shows a circumferential view taken along lines 8—8 of FIG. 7.
Figure 7:
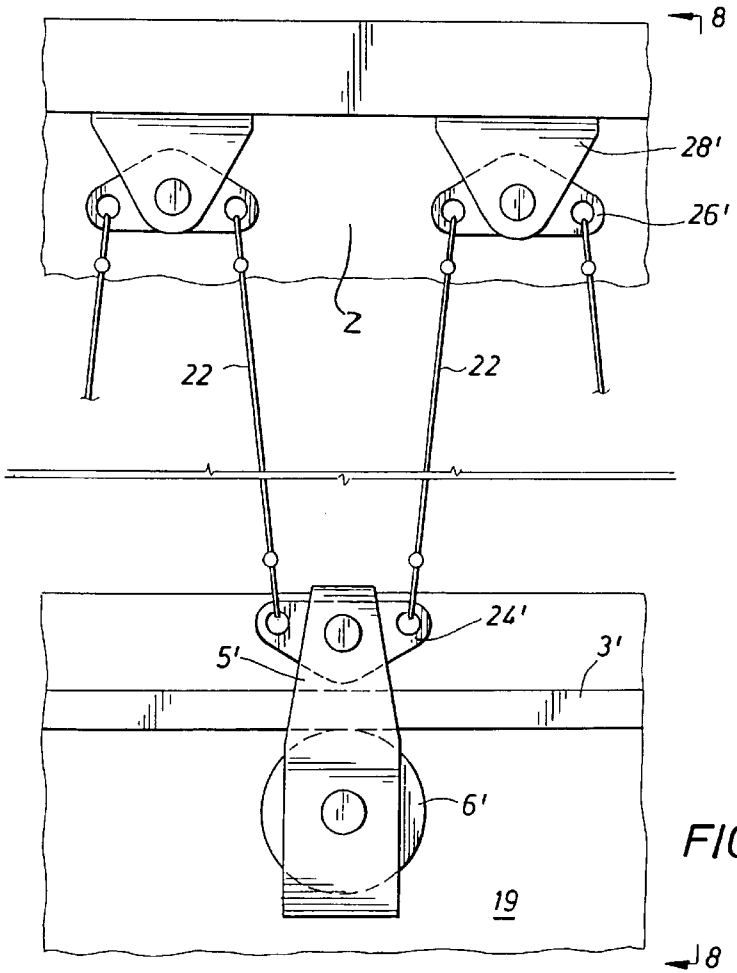
FIG. 7 shows a radial view of an alternative turret suspension arrangement with bogies provided to roll on a rail of the riser support structure.

FIGS. 7 and 8 show radial and circumferential views of the bogies 5' and rocker beam 24' suspension arrangement with the bogies 5' arranged to roll on a rail 3 of the riser support structure 19 of turret 4. In the event of uplift, the bogies 5' can be equipped with rollers 50' or sliding blocks as shown in FIG. 7A which prevent the upward displacement of the bogies' relative to the moon pool edge. In this configuration, the turret suspension members 22 are compression resistant members (e.g., rods or pipes) and capable of transmitting downward load on the turret to prevent uplift. As the vertical loads are shared equally among all suspension members, the uplift problem may go away, because a load reversal of one rod requires all rods to go equally into compression. As long as the net force on the turret is downward, the uplift wheels 50' or sliding blocks will not be necessary. As illustrated in FIG. 8, a radial bearing 57 is provided between riser guide tube deck 8 and a circumferential surface of the moonpool 2.

Figure 9:
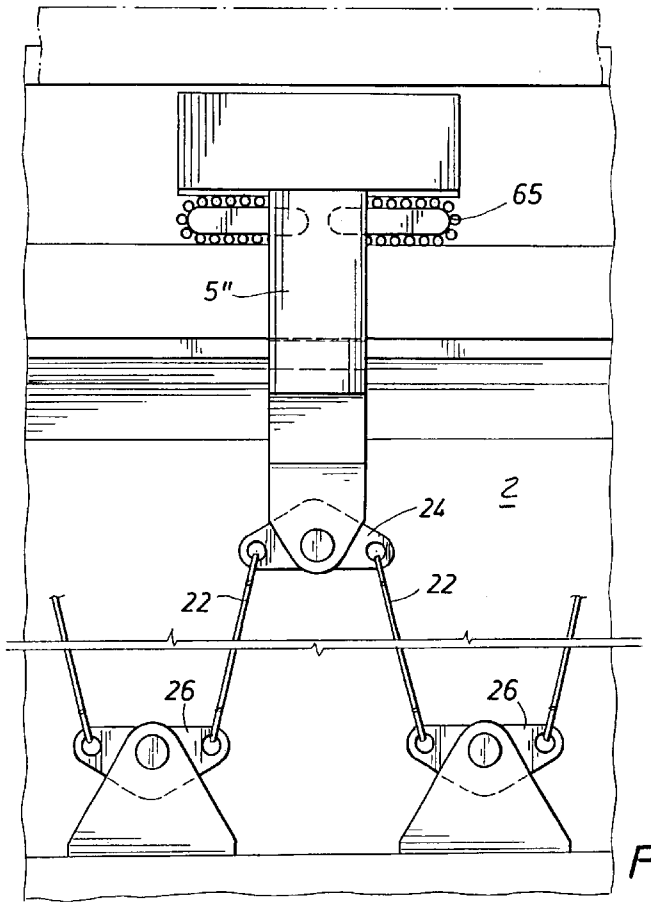
FIGS. 9 and 10 are radial and circumferential views of an alternative turret suspension arrangement where the bogie housing is configured to use Hillman rollers.
Figure 10:
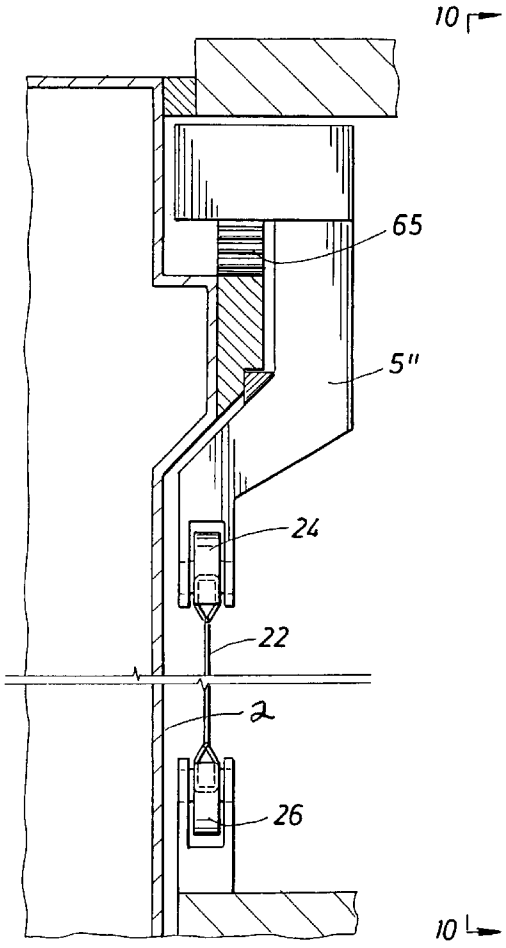

FIGS. 9 and 10 show radial and circumferential views of the bogies 5" and rocker arm 24 suspension arrangement, with the bogies 5" configured to use Hillman rollers 65.

Figure 11:
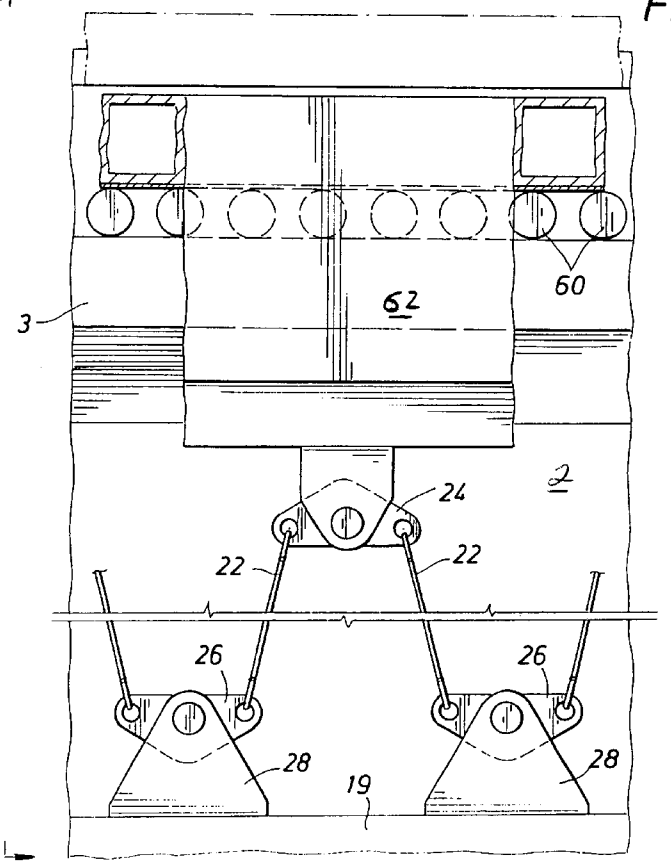
FIGS. 11 and 12 are radial and circumferential views of the suspension system using a roller bearing and flexible ring to support the rocker beams and suspension members.
Figure 12:
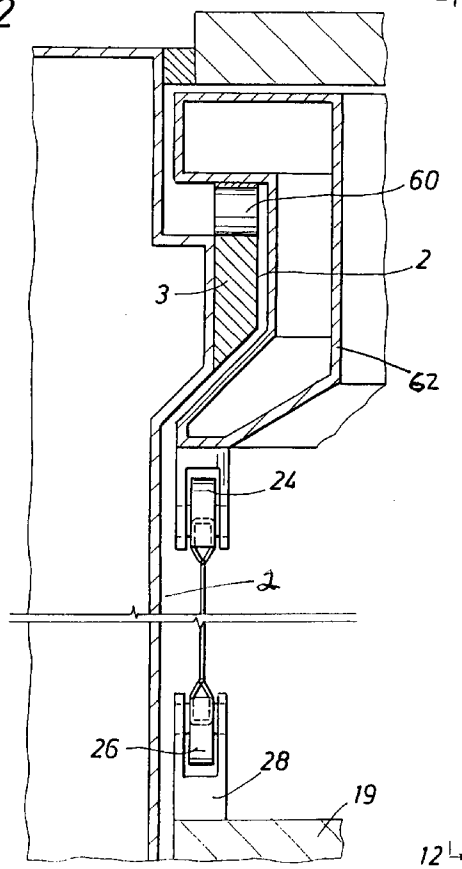

FIGS. 11 and 12 show radial and circumferential views of an alternative arrangement of the suspension system using a roller bearing 60 and flexible ring 62 to support the rocker beams 24 and suspension members 22. In this configuration, the flexible ring 62 is mounted over the roller bearing 60 for suspension of the turret system, thereby providing a uniform circumferential load on the bearing without moment, allowing radial distortion between the roller bearing 60 and the flexible ring 62, without direct attachment to the rigid structure.

Figure 13:
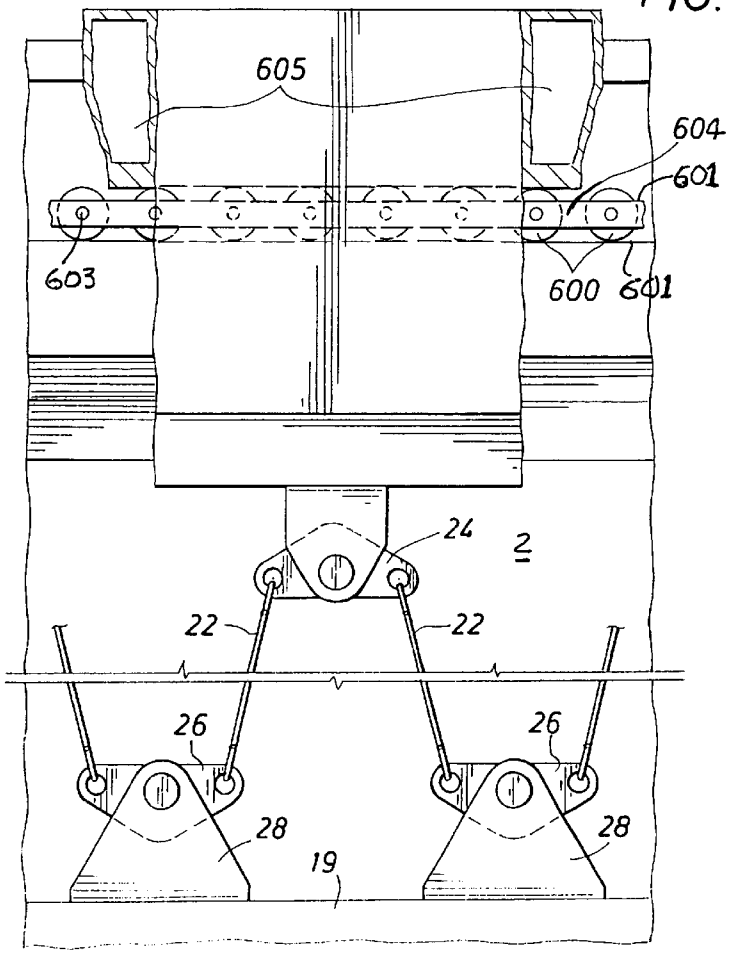
FIGS. 13 and 14 are radial and circumferential views of the suspension system using captive rollers for supporting the turret load where the rollers are captured between a rail on the vessel and a flex ring of the bogie housing with turret load transferred through a rocker suspension arrangement attached to the flexible ring.
Figure 14:
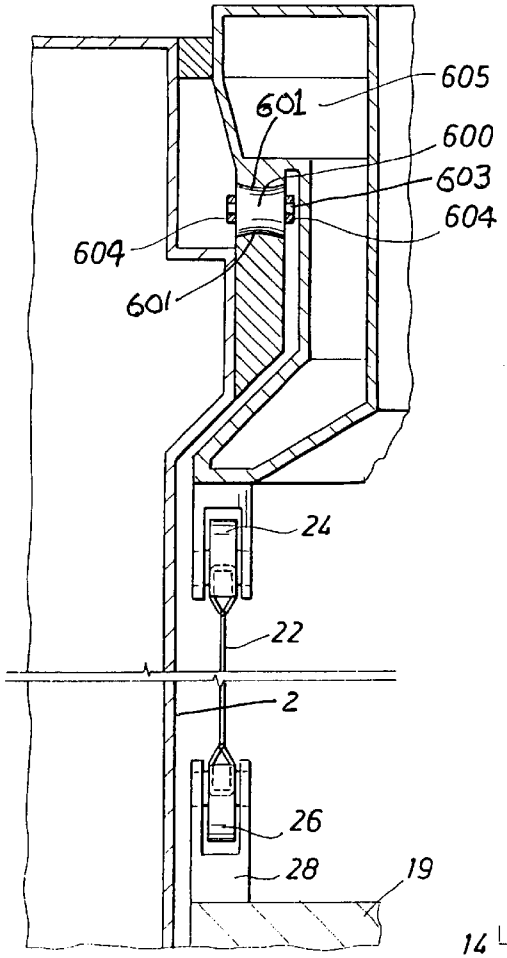

FIGS. 13 and 14 show radial and circumferential views of an alternative arrangement of the suspension system using captive roller bogies 600 supporting the turret load through rolling bogies and two opposing rails 601 with the turret load transmitted through the rocker suspension arrangement attached at the top to a flexible ring 605. In this configuration, the vertical load is passed through a bogie wheel 600 rather than through a shaft through the wheel. The flex ring 605 is rigid enough to distribute loads over multiple wheels, but less rigid than the hull, and thereby capable of flexing with the hog and sag of the hull. Being cylindrical of thin section in the radial direction, it can flex in the radial direction to follow the ovality of the moon pool 2 in a plan view (not shown). The bogie wheels 600 are kept apart through spacer rings 604 which hold back bogie shaft 603 captive.

FIGS. 15–18 respectively show a plan, radial and circumferential views of a turret suspension configuration, without tension members, which features turret rocker beams 26''' resting directly on bogies 5''' which have frames forming integral rocker beams. Rocker shafts 62 connect the rocker beams 26''' to the turret 4. (See FIGS. 15 and 17)

In most of the embodiments described above, the bogie rail 3 can be installed in a recess below the vessel deck to permit radial bearings to be attached to the hull and slide on the turret. Alternatively as shown in FIGS. 7 and 8 the rail 3' can be mounted on the turret with the bogies configured as hooks with rocker beams 28' welded to the structure within the moonpool.

In order for the bogies of all the embodiments described above to roll, the weathervaning torque of the vessel must overcome the friction in the lower bearing, upper radial bearing, and swivel. The bogies, being the most compliant component of the elements exhibiting relative motion, begin to turn with respect to the vessel last and only when the suspension members (especially tension members) deflect to produce a horizontal component of force sufficient to overcome the static coefficient of friction preventing motion. At that point, the bogies surge ahead and then come to a new equilibrium static position. Depending on the parameters of the system, the bogies can initiate rolling one at a time, and surge ahead independently of one another. If this is a problem, a pin fixed to the turret can be inserted into a vertical slot on the bogie so that the bogie remains fixed in the circumferential direction relative to the turret. (See FIG. 6, for example) This smoothes the motion of the bogies. The pin can be bushed with elastic material, to further soften the start/stop tendencies of the bogies. Alternatively, spars or connection points on the turret can support a tension member connected to each bogie in the circumferential direction so that the relative angular rotation of the bogies can be maintained very nearly equal in magnitude and timing, relative to the turret.

What is claimed is:

1. A vessel which includes a large turret that is positioned in a moonpool in the middle portion of a vessel hull where the turret is anchored to a sea floor and includes couplings wherein the vessel is supported in rotation about a primarily vertical axis of said turret wherein, said coupling including an axial bearing arrangement characterized by, a rail positioned in a horizontal plane which is perpendicular to said vertical axis, a plurality of bogie housings, each carrying a bogie wheel, with each bogie wheel arranged to roll on said rail, a first set of rocker beams pivotably connected to said bogie housings, a second set of rocker beams pivotably mounted to support members, suspension members connected between said first set of rocker beams and said second set of rocker beams, wherein said rail is alternatively carried by said vessel or by said turret and said support members are respectively alternatively connected by said turret or to said vessel.

2. The vessel of claim 1 wherein, said rail is carried by said vessel, said bogie housings are arranged so that said bogie wheels roll on an upward facing horizontal surface of said rail, said support members are secured to said turret, and said suspension members are tension members.

3. The vessel of claim 2 further comprising, a safety stop mounted on said turret below at least one rocker beam of said second set of rocker beams.

4. The vessel of claim 2 further comprising, a plurality of turret deck supports mounted on said turret and extending upwardly therefrom in said moonpool and radially inwardly of said rail, a horizontal riser guide tube deck supported on said turret deck supports, and radial couplings placed between said riser guide tube deck and said bogie housings.

5. The vessel of claim 4 further comprising, radial bearing members disposed between said rail and said horizontal riser guide tube deck.

6. The vessel of claim 5 further comprising, a plurality of riser guide tubes extending from said turret upwardly to said riser guide tube deck.

7. The vessel of claim 6 wherein, from 80 to 120 riser guide tubes are terminated at said riser guide tube deck.

8. The vessel of claim 6 further comprising, an upper deck supported on said turret deck supports above said riser guide tube deck, and a swivel stack mounted on said upper deck.

9. The vessel of claim 5 further comprising, a lower radial bearing positioned about an outer peripheral surface of said turret and an inner peripheral surface of said moonpool.

10. The vessel of claim 1 wherein, said rail is carried by said turret, said bogie housings are arranged so that said bogie wheels roll on a downward facing horizontal surface of said rail, and said support members are secured to said vessel, and said suspension members are tension members.

11. The vessel of claim 1 wherein, said rail is carried by said turret, said bogie housings are arranged so that said bogie wheels roll on an upward facing horizontal surface of said rail, said support members are secured to said turret, and anti-uplift wheels are mounted between a bottom horizontal surface of said rail and said first set of rocker beams, and said suspension members are compression members.

12. The vessel of claim 1 wherein, a moment arm length of a connection of each suspension member to each rocker beams of said first and second sets of rocker beams is substantially the same.

13. The vessel of claim 1 wherein, said suspension members are compression members.

14. A vessel which includes a large turret that is positioned in a moonpool in the middle portion of a vessel hull where the turret is anchored to a sea floor and includes couplings wherein the vessel is rotatably supported about a primarily vertical axis of said turret said coupling including an axial bearing arrangement characterized by, a circular rail positioned carried by said vessel in a horizontal plane which is perpendicular to said vertical axis, said rail having an upper facing surface, a plurality of bogie housings, each housing having downward facing surface and at least one Hillman roller assembly designed and arranged for rolling support between said upward facing surface of said housing, a first set of rocker beams pivotably connected to said bogie housings, a second set of rocker beams pivotably coupled to said turret, and suspension members connected between said first set of rocker beams and said second set of rocker beams.

15. The vessel of claim 14 wherein, said suspension members are tension members.

16. The vessel of claim 14 wherein, said suspension members are compression members.

17. A vessel which includes a large turret that is positioned in a moonpool in the middle portion of a vessel hull where the turret is anchored to a sea floor and includes couplings wherein the vessel is rotatably supported about a primarily vertical axis of said turret said coupling including an axial bearing arrangement characterized by, a circular rail positioned carried by said vessel in a horizontal plane which is perpendicular to said vertical axis, said rail having an upper facing surface, a plurality of bogie housings, each housing having an upper flexible portion with a downwardly facing surface and a roller bearing assembly designed and arranged for rolling support between said upward facing surface of said rail and said downward facing surface of said flexible portion of said bogie housing, a first set of rocker beams pivotably connected to said bogie housings, a second set of rocker beams pivotably coupled to said turret, and suspension members connected between said first set of rocker beams and said second set of rocker beams.

18. The vessel of claim 17 wherein, said suspension members are tension members.

19. The vessel of claim 17 wherein, said suspension members are compression members.

20. A vessel which includes a large turret that is positioned in a moonpool in the middle portion of a vessel hull where the turret is anchored to a sea floor and includes couplings wherein the vessel is rotatably supported about a primarily vertical axis of said turret said coupling including an axial bearing arrangement characterized by, a circular rail carried by said vessel in a horizontal plane which is perpendicular to said vertical axis, said rail having an upper facing surface, a plurality of bogie housings, each housing having an upper flexible portion with captive roller assemblies mounted thereon which are designed and arranged for rolling support on said upward facing surface of said rail, a first set of rocker beams pivotably connected to said bogie housings, a second set of rocker beams pivotably coupled to said turret, and suspension members connected between said first set of rocker beams and said second set of rocker beams.

21. The vessel of claim 20 wherein, said suspension members are tension members.

22. A vessel which includes a large turret that is positioned in a moonpool in the middle portion of a vessel hull where the turret is anchored to a sea floor and includes couplings wherein the vessel is rotatably supported about a primarily vertical axis of said turret said coupling including an axial bearing arrangement characterized by, a circular rail carried by said vessel in a horizontal plane which is perpendicular to said vertical axis, said rail having an upper facing surface, a plurality of bogie housings, each housing circumferentially spaced from each other, with each housing carrying a bogie wheel and with each bogie wheel arranged to roll on said rail about a radially oriented pin through said housing, each housing having horizontally extending housing arms which extend in opposite directions from said pin, a plurality of rocker beams having rocker arms each of which extends from a radially extending rocker beam shaft, each of said rocker beams being positioned between two circumferential spaced bogie housings with a rocker arm of each rocker beam being linked to an adjacent housing arm of a bogie housing, and wherein each rocker beam shaft is coupled to said turret.

* * * * *